United States Patent [19]

Goldstein

[11] Patent Number: 4,477,037

[45] Date of Patent: Oct. 16, 1984

[54] STRETCH-WRAP FILM DISPENSER

[76] Inventor: Joseph Goldstein, 1325 Southwind Cir., Westlake Village, Calif. 91361

[21] Appl. No.: 480,099

[22] Filed: Mar. 29, 1983

[51] Int. Cl.[3] ..... B65H 17/44; B65H 23/06; B44C 7/00

[52] U.S. Cl. ..... 242/75.4; 242/96; 242/99

[58] Field of Search ..... 242/96, 99, 68.4, 75.4, 242/156, 156.1, 156.2

[56] References Cited

U.S. PATENT DOCUMENTS

| | | | |
|---|---|---|---|
| 406,672 | 7/1889 | Schultze | 242/99 |
| 1,415,678 | 5/1922 | Moynihan | 242/96 |
| 4,166,589 | 9/1979 | Hoover et al. | 242/75.4 |
| 4,226,380 | 10/1980 | Gay | 242/55 |
| 4,248,392 | 2/1981 | Parry | 242/99 X |

FOREIGN PATENT DOCUMENTS

| | | | |
|---|---|---|---|
| 553251 | 5/1943 | United Kingdom | 242/156 |

*Primary Examiner*—Stuart S. Levy
*Assistant Examiner*—Lloyd D. Doigan
*Attorney, Agent, or Firm*—Allan M. Shapiro

[57] ABSTRACT

Stretch wrap film is wound on a mandrel or core which is longer than the roll of film to extend out of both ends. A rotatable handle is mounted on the core outboard of the film. Relative braking between the handle and core is adjusted by means of a screwthread which tightens a friction brake. The dispenser is carried around an article to be wrapped and the tension of the film is controlled by adjusting the brake by rotating its controlling nut. With a large core, an extension can be attached to a plug therein. Furthermore, instead of a spiral surface as on a nut and stud, a spring may be used to control brake force.

5 Claims, 10 Drawing Figures

STRETCH-WRAP FILM DISPENSER

BACKGROUND OF THE INVENTION

This invention is directed to an improved stretch-wrap film dispenser wherein the dispenser can be manually carried around an article to wrap the article with the tension of the stretch-wrap film being manually controlled by control of the brake.

When a plurality of packages are grouped together, it is desirable to combine them into a load, often of the size of a pallet so that the merchandise can be transported and stored in pallet-size units. The stretch-wrap film can be wrapped around such a group to unitize the packages. The stretch-wrap film is a polymer sheet film of resilient nature. The stretch-wrap film must be applied in the tensioned, stretched form in order to securely wrap the plurality of packages into a unit.

Various types of machinery are available to move a roll of stretch-wrap film around articles to be wrapped, and similar apparatus is available where articles to be wrapped are rotated adjacent a fixed roll of stretch-wrap film. For the most part, these devices are fairly completely mechanized and powered. As a result of this, the equipment becomes complex and expensive.

Such mechanical strutures have tension control means thereon so that a constant tension is applied during the entire wrapping process. When fully mechanized, such constant tension is a desirable goal. However, when the roll is manually moved arond the load being stretch-wrapped, variations in tension from one wrapping turn to the next may be easily adjusted by the worker as he wraps the packages. Thus, there is need for a stretch-wrap film dispenser where the worker can quickly, conveniently and accurately adjust the tension of the stretch-wrap film.

SUMMARY OF THE INVENTION

In order to aid in the understanding of this invention, it can be stated in essentially summary form that it is directed to an improved stretch-wrap film dispenser for use with stretch-wrap film wound upon an elongated core or hollow mandrel which extends past the film on both ends. The dispenser includes handles rotatably mountable on the mandrel at each end thereof and inter-engaging brake means between the handle and the core so that adjustment of the brake controls unwinding tension of the stretch-wrap film as the worker carries it around the packages to be wrapped into a unit. Control of the brake is by rotation of a nut on a threaded shaft so that once made, the tension stays relatively constant until nut rotation is manually accomplished. When the film is on a large core, a plug may be employed for carrying an extended, axial tube. Instead of a spiral surface as on a nut and stud, a spring may be used to control the brake tension.

It is an object of this invention to provide an improved stretch-wrap film dispenser which is economic of construction, easy to use and which accurately controls the tension and positioning of stretch-wrap film as it is wrapped around a plurality of packages to join them into a unit.

It is a further object of this invention to provide an improved stretch-wrap film dispenser which acts with an extended core having stretch-wrap film thereon, or with an extension to the core where the core is of large diameter so that an axial bearing surface is provided on which a handle sleeve can be positioned. The handle sleeve has a spiral surface acting with an internal tension member or acts with a spring to control the pressure on friction surfaces between the handle sleeve and the roll of stretch-wrap film.

It is another object of this invention to provide an improved stretch-wrap film dispenser which is sufficiently economic of construction to be employed as a throwaway device and is sufficiently precise to permit the operator to wrap packages into a unit with properly controlled tension.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENTS

Figure 1:
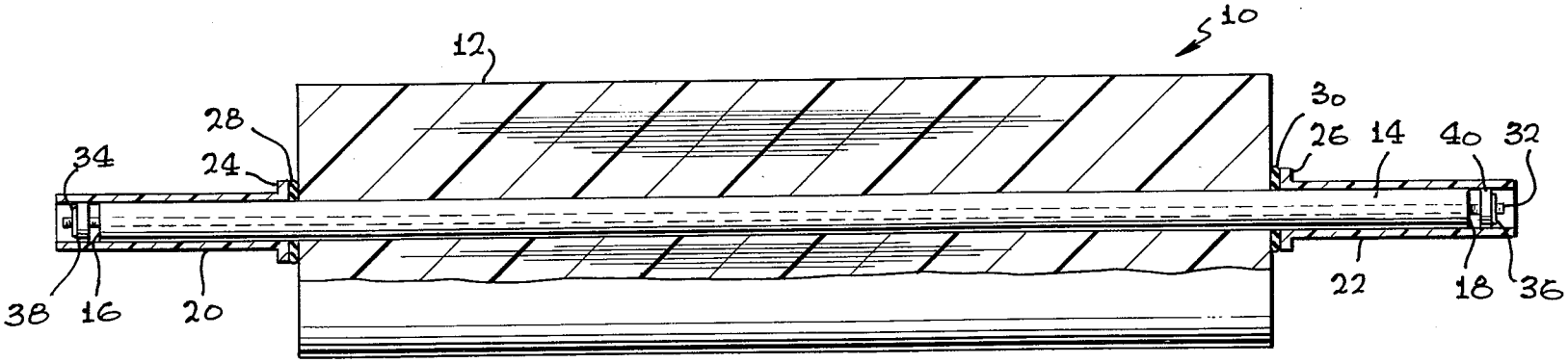
FIG. 1 is a side-elevational view of the first preferred embodiment of the improved stretch-wrap film dispenser of this invention, with parts broken away and parts taken in section.
Figure 2:
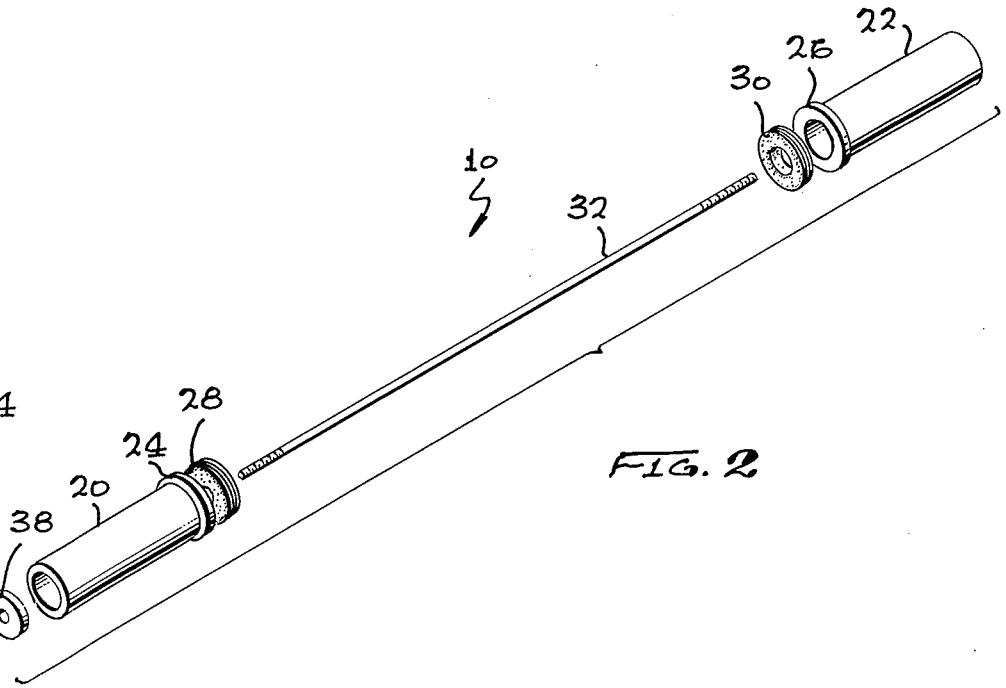
FIG. 2 is an exploded isometric view thereof without the stretch-wrap film and its extended core.
Figure 3:
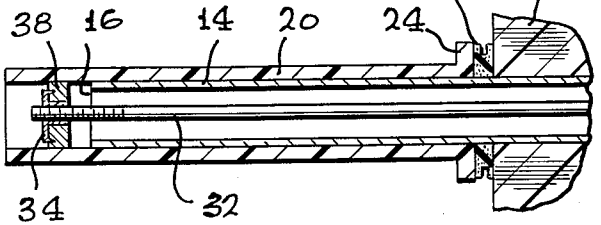
FIG. 3 is an enlarged longitudinal axial sectional view of one end of the strcture of FIG. 1.
Figure 4:
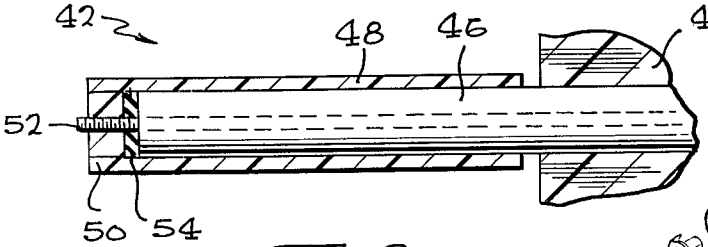
FIG. 4 is a view similar to FIG. 3, with some parts taken in axial section and with the extended central core being taken in side elevation, of a second preferred embodiment of the improved stretch-wrap film dispenser of this invention.

The first preferred embodiment of the improved stretch-wrap film dispenser of this invention is generally indicated at 10 in FIG. 1. Portions thereof are shown in exploded position in FIG. 2, and one end thereof is shown in axial section in FIG. 3. Stretch-wrap film dispenser 10 comprises a roll of stretch-wrap film 12 on an elongated core 14. Core 14 is preferably an extruded PVC tube, or the like. Core 14 extends axially past the ends of film roll 12 on both ends thereof. Left end 16 and right end 18 are shown in FIG. 1, and the left end is shown in FIG. 3.

Left and right handles 20 and 22 are tubes which engage around the extended core 14 where it extends outward from the end of the film roll. The handles are freely rotatable on the core. Flanges 24 and 26 are respectively formed on the handles. Elastomeric brake washers 28 and 30 are respectively positioned between the flanges and the ends of the roll of stretch-wrap film. By thrusting the handles together, the flanges squeeze the brake washers against the roll, to increase the torque required to unwind film from the roll, and thus control film tension.

Tension member 32 is in the form of an elongate bar which has threads at least on the ends. Tension in the bar is transferred to the handle sleeves through nuts 34 and 36 which engage in discs 38 and 40 which are fixed in the outer ends of the handle sleeves. The handles are preferably of tubular thermoplastic stock, such as PVC, and the discs 38 and 40 may be of wood or cardboard which are held in place by glue and/or staples. By rotating the handles relatively to each other, the nuts acting on the threaded tension bar 32 move the handles 20 and 22 towards or away from each other to control the force on the brake washers to thus control the tension. Thus, clockwise rotation of either handle increases the tension and relative counter-clockwise rotation decreases the tension. The operator holds one handle in each hand and walks around the packages to be wrapped as a unit. The starting end of the film is tucked into the group of packages, and the operator walks around the group. He controls the tension as he walks around the group to assure that the packages are being wrapped with the proper stretch in the wrapping film. The tension can be constantly adjusted as he wraps the packages into a unit. It is the space between the ends 16 and 18 of the core 14 with respect to the discs 38 and 40 that permit the handles to move towards each other. Under the tension of tension rod 32, all of the tension forces are delivered to the brake washers 28 and 30.

The stretch-wrap film dispenser 42 is shown for one end of the structure. The two ends are identical, as was illustrated in the embodiment shown in FIG. 1. In the dispenser 42, film roll 44 is wound on core 46 which extends from both ends of the roll of stretch-wrap film. Handle 48 is one of two identical handles, one on each end of core 46. Handle 48 is freely rotatable on the extended portion of the core and has a cap 50 thereon. The cap 50 can be a polymer composition plug inserted in the end of handle 48 and secured therein by stapling and/or gluing or the like. Cap 50 has a threaded opening therein, which may be directly threaded into the cap or may be a threaded insert. Tension member 52 is a threaded rod, the same as tension member 32, and is threaded into the threaded openings in the two handles. Brake washer 54 is positioned between the outer end of core 46 and cap 50, and a similar brake washer is positioned on the other end of core 46. As the two handles on opposite ends of the core 46 are rotated, due to the threaded portions of the tension member, the handles move towards or away from each other. When they are rotated clockwise, the handles move towards each other and compress the brake washers against the ends of the core 46 to increase tension. As the operator holds the two handles and walks around the packages to be wrapped into a unit, he holds both of the handles and pulls the stretch-wrap film around the packages to cause tension therein. Tension can be continuously controlled by relative twisting or rotation of the handles to tighten or loosen the compression on the brake washers. Thus, the operator has continuous control as he wraps the packages into a unit.

Figures 5, 6, 7, 8, 9, 10:
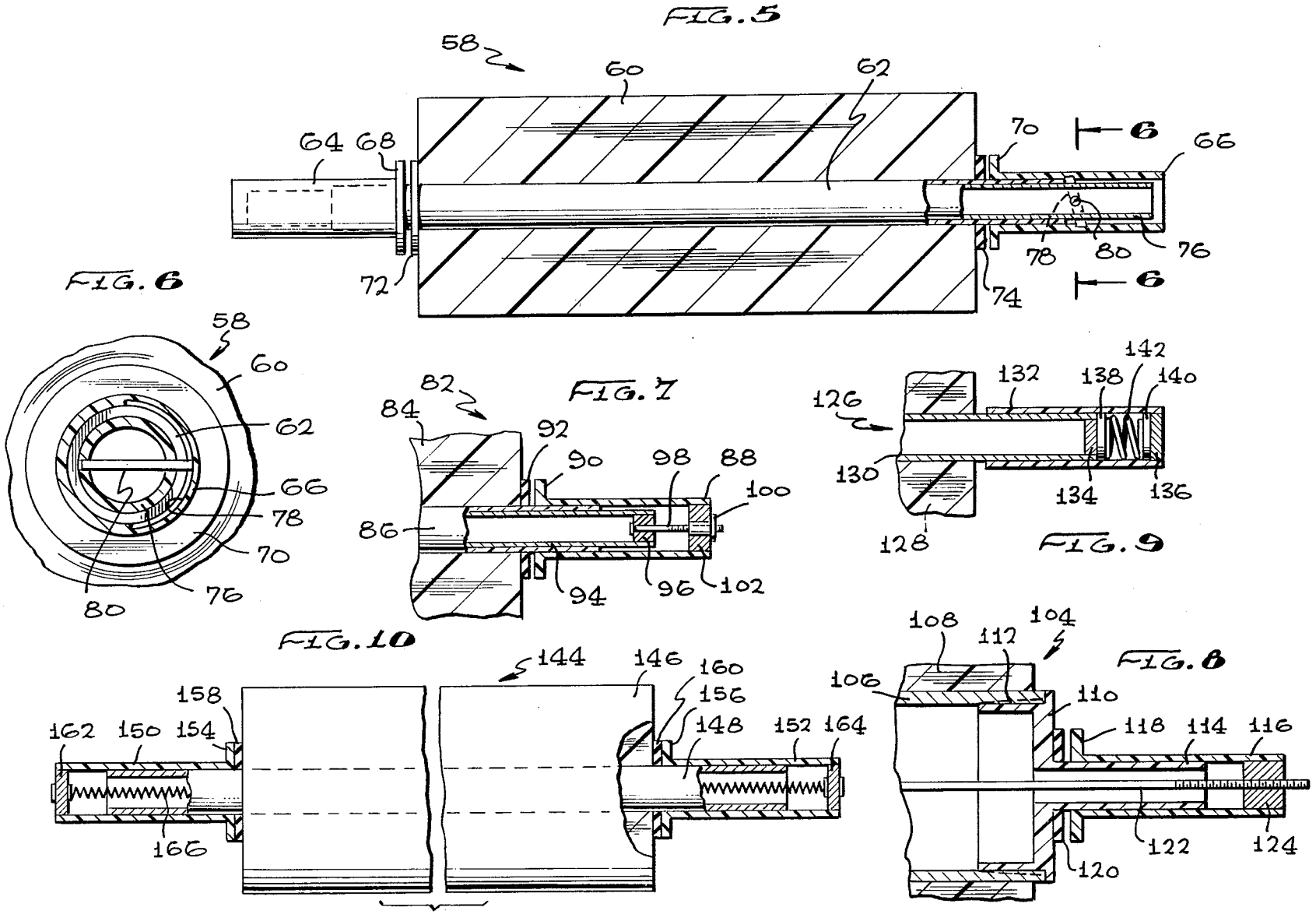
FIG. 5 is a side-elevational view of a third preferred embodiment of the improved stretch-wrap film dispenser of this invention, with some parts taken in central axial section.
FIG. 6 is an enlarged section taken generally along the line 6—6 of FIG. 5.
FIG. 7 is a central axial section through a fourth preferred embodiment of the improved stretch-wrap film dispenser of this invention, with parts broken away.
FIG. 8 is a longitudinal sectional view through the axis of a fifth preferred embodiment of the improved stretch-wrap film dispenser of this invention, with parts broken away.
FIG. 9 is an axial section through a sixth preferred embodiment of the improved stretch-wrap film dispenser of this invention, with parts broken away.
FIG. 10 is a side-elevational view of a seventh embodiment of the improved stretch-wrap film dispenser of this invention, with parts taken in central axial section and parts broken away.

FIGS. 5 and 6 illustrate the stretch-wrap film dispenser 58 which also employs relative spiral surfaces to control brake tension. Stretch-wrap film 60 is wound on core 62 which extends past the ends of the roll of film 60. Handles 64 and 66 are in the form of sleeves which are rotatably mounted on the extended ends of the tubular core. Flanges 68 and 70 are formed on the handles and are positioned towards the film roll. Brake washers 72 and 74 are positioned between the flanges and the roll of film 60. When the handles are moved towards each other, the brake washers are compressed to provide unrolling tension. Tension member 76 extends through the interior of core 62 and extends out past the ends thereof to engage both of the handles 64 and 66. The core 62, the tension member 76 and both of the handles 64 and 66 are preferably made of a fairly rigid thermoplastic extruded tubing, such as polyvinyl chloride. They are sized so that they can move with respect to each other without excessive spacing. Control of the tension by relative rotation of the two handles is accomplished by means of a spiral cam groove 78 on the interior of each of the handles. The groove 78 is shown in handle 66 in FIGS. 5 and 6, and a similar groove is provided in handle 68. Crosspin 80 extends through tension member 76, see FIG. 6, and extends into spiral cam groove 78. The sprial cam groove 78 is spiraled in the same sense as a screwthread so that rotation on the central axis causes relative axial movement. The two spiral cam groovs are in the same orientation so that when the handles are relatively rotated clockwise, the pressure on the brake washers is increasd to increase unwinding tension. Relative rotation in the counter-clockwise direction causes decrease in the unwinding tension.

The stretch-wrap film dispenser 82 in FIG. 7 is similar to the structure of FIG. 5 but uses a screwthreaded bolt and nut instead of a spiral groove and pin. Film roll 84 is wound on extended core 86 which as a handle rotatably mounted on each end thereof, with handle 88 shown on the right end. The left end is symmetrically identical. Handle 88 carries flange 90 which compresses brake ring 92 between the flange and film roll. Tension member 94 extends between the two handles and carries a plug 96 in the end thereof. Bolt 98 has its head engaged behind plug 96 and has its screwthreaded outer end engaged in nut 100. Nut 100 is engaged in plug 102 in the outer end of the handle. In this way, the handles can be moved towards each other by providing tension through the tension member. This structure is very similar to the structure of FIG. 1 except that, in the case of dispenser 82, the tension member is partly formed of extruded tubing.

In the stretch-wrap film dispenser 104 illustrated in FIG. 8, the dispenser is illustrated as being configured for a larger standard core which is the same length as the roll of stretch-wrap film 108. Plug 110 is pressed into each end of the core 106 and is irrotatably held therein by means of axial ribs 112 on the outside of the plug. Plug 110 carries bearing tube 114 which is axially secured to the plug and serves as an extension thereof. Bearing tube 114 is sufficiently small that handle 116 is rotatably mounted on the exterior thereof. Flange 118 on the handle cooperates with brake washer 120 which lies adjacent the plug. Thus, axial movement of the handle towards the plug increases friction. Tension member 122 extends through the interior and engages in threaded plug 124 in the outer end of the handle. The other end of the dispenser 104 is similarly equipped. In this way, relative clockwise rotation of the handles causes an increase in tension by compressing the brake disc. The tension can be continuously controlled as the operator moves the roll of stretch-wrap film around the packages to be wrapped together.

The embodiments thus far described rely on screwthreads to control the force of the handles onto the brake washers. Relative rotation causes tightening. In the stretch-wrap film dispenser 126 shown in FIG. 9, a roll 128 is wound on an elongated core 130. One end of the roll and core is shown, and the other end is identical. The core extends out past the end of the roll and serves as a bearing upon which handle 132 rotates. The outer end of core 132 carries plug 134 while the outer end of handle 132 carries plug 136. Brake washers 138 and 140 are respectively positioned against the plugs. Compression spring 142 is positioned between the washers. An identical structure is positioned on the other end of core 130. When an axial inward force is applied, with the handles urged towards each other, the handles rotate and slide on the core and the axial compression force is felt by compression spring 142. This force is also applied to the two brake washers which engage against the plugs to cause rotary friction restraining rotation of the handle on the core. Thus, unwinding tension is controlled by inward axial force which appears on the brake wahsers through the springs.

The stretch-wrap film dispenser 144 of FIG. 10 is similar to the stretch-wrap film dispenser 10 of FIG. 1. Stretch-wrap film is wound into a roll 146 on core 148 which extends out of both ends of the film roll. Handles 150 and 152 are rotatably mounted on the extended ends of the core. Flanges 154 and 156 are formed on the handles at the end facing the film roll. Brake washers 158 and 160 are positioned between the flanges and the film roll. Axial force on the handles, urging them towards each other, increases the unwinding friction by compressing the brake washers. Plugs 162 and 164 are fixed in the outer ends of the handles, and tension spring 166 is attached to the plugs. The handles are rotatably and axially slidable on the extended ends of the core so that the tension of spring 166 applies an axial force to the handles in the direction towards each other to provide an axial force on the brake washers 158 and 160. Thus, as the operator holds the handles and travels around the packages to be wrapped into a unit, if he applies no axial force, the tension of the spring controls the winding tension of the stretch-wrap film. Of course, the operator can modify the stretch-wrap film tension by applying an inward axial force on the handles to increase the stretch-wrap film tension or an outward axial force on the handles to decrease the stretch-wrap film tension. Furthermore, tension spring 166 can be adjustably mounted so that the spring force can be adjusted and the force applied to the brake washers by the spring can be adjusted.

In each of the embodiments of the stretch-wrap film dispenser, the tubular members are extruded fairly rigid thermoplastic material, such as polyvinyl chloride. The fits are such as to permit rotational and axial freedom. The plugs are preferably made of cardboard or wood and can be stapled in place. The out-turned flanges on the handles in several embodiments can be thermoplastically formed of the original tubular thermoplastic material. Thus, each stretch-wrap film dispenser can be economically constructed and can be built as a throwaway device. Thus, there is no need for disassembly and rewinding of the core. With a throwaway device of that nature, wide use thereof can be enjoyed in many small production shops.

While the stretch-wrap film dispensers have been described as being carried around a stationary group of packages, it is clear that the group of packages can be rotated while the operator stands still, holding the dispenser. It is the relative rotation that is required for the stretch-wrapping operation.

This invention has been described in its presently contemplated best mode, and it is clear that it is susceptible to numerous modifications, modes and embodiments within the ability of those skilled in the art and wthout the exercise of the inventive faculty. Accordingly, the scope of this invention is defined by the scope of the following claims.

What is claimed is:

1. A single use, throwaway stretch-wrap film dispenser comprising:

an elongated substantially rigid tubular polymer material core defining an axis, a roll of stretch-wrap film wound on said core, said roll of stretch-wrap film being positioned so that a portion of said core extends outwardly on each end past said roll of stretch-wrap film, said core rotating with said roll of stretch-wrap film;

a polymer material tubular handle rotatably mounted on each end of said core outboard of said roll of stretch-wrap film and receiving said core within said handle for manual grasp around the axis, an outwardly directed radial flange integrally formed on each said handle, said flanges being on the ends of said handles toward said roll of stretch-wrap film;

a brake disc engaged by said flange on each said handle so that increased axial pressure on said brake discs causes increased rotative drag between said roll of stretch-wrap film and said handles; and a screw-threaded tension member extending completely through said core and interengaging said handles outward of said core to control axial force on said brake means, said interengagement comprising a threaded nut positioned in each of said handles outward of said core and engaging on said screwthread so that said nuts screw down upon said screwthread as one of said handles is rotated with respect to the other of said handles to compress said brake discs.

2. The stretch-wrap film dispenser of claim 1 wherein said nut is mounted in a plug in said one of said handles.

3. A single use, throwaway stretch-wrap film dispenser comprising:

an elongated core for the winding thereon of a stretch-wrap film, said core including means for extending outwardly beyond a portion of said core on which stretch-wrap film is to be wound, said core means comprising a thermoplastic polymer cylindrical tube lying on the same axis as the axis of said core;

a substantially rigid thermoplastic polymer tubular handle mounted on each end of said cylindrical tube and receiving said cylindrical tube within said handle so that each handle can rotate and axially move on said cylindrical tube, each said handle having an integrally formed outwardly directed radial flange thereon, said handles being positioned on said tube with said flanges away from the ends of said tube;

a brake washer adjacent each end of said cylindrical tube and being positioned to be respectively engaged by said flanges on said handles upon axial movement of said handles; and a tension member interengaging said handles, said tension member being a rod having screwthreads on both ends thereof, a nut positioned in each of said handles, said rod being engaged in both nuts so that upon relative rotation of said handles said nuts turn on said screwthread to cause relative axial motion of said handles to control the force of both of said handles against their respective brake washers to control the rotative drag of said core with respect to said handles to control the unwinding tension of stretch-wrap film as it is run from said core.

4. The stretch-wrap film dispenser of claim 3 wherein said brake washer is engaged between said flange and a roll of stretch-wrap film on said core.

5. A single use, throwaway improved stretch-wrap film dispenser comprising:

an elongated extruded thermoplastic cylindrically tubular core for carrying a roll of stretch-wrap film intermediate the ends thereof, said core being sufficiently long to extend beyond the roll of stretch-wrap film thereon on both ends thereof so that a cylindrical bearing surface on said tube extends beyond the film wound thereon;

a cylindrically tubular handle made of extrudable thermoplastic material positioned on each of said bearing surface and receiving said bearing surface within said handle, said handles each having an integral out-turned flange thereon on the ends facing each other, said handles extending outward past the ends of said tubular core, a plug in the outer end of each of said handles, said plugs being spaced away from the outer ends of said core, a nut in each of said plugs;

a disc brake washer positioned around said bearing to be engaged by said flange so that flange pressure on said brake washer causes increased rotative friction between said handles and said core; and a threaded rod interengaged between said nuts in said handles so that relative rotation of said handles causes relative axial motion of said handles to cause increased force on said brake wahsers to cause increase in unwinding tension of stretch-wrap film from said core.

* * * * *